US006857959B1

(12) United States Patent
Nguyen

(10) Patent No.: US 6,857,959 B1
(45) Date of Patent: Feb. 22, 2005

(54) NAME YOUR PRIZE GAME PLAYING METHODOLOGY

(75) Inventor: Binh T. Nguyen, Reno, NV (US)

(73) Assignee: IGT, Reno, NV (US)

( * ) Notice: Subject to any disclaimer, the term of this patent is extended or adjusted under 35 U.S.C. 154(b) by 0 days.

(21) Appl. No.: 09/515,717

(22) Filed: Feb. 29, 2000

(51) Int. Cl.[7] ..... A63F 9/24
(52) U.S. Cl. ..... 463/25; 700/91; 340/323 R
(58) Field of Search ..... 463/1, 12–13, 463/16, 20–22, 25, 29, 36, 40–42; 273/292–293, 143 R; 340/323 R; 705/14

(56) References Cited

U.S. PATENT DOCUMENTS

| | | | | |
|---|---|---|---|---|
| 5,643,086 A | | 7/1997 | Alcorn et al. | 463/29 |
| 5,655,961 A | | 8/1997 | Acres et al. | 463/27 |
| 5,702,304 A | | 12/1997 | Acres et al. | 463/29 |
| 5,741,183 A | | 4/1998 | Acres et al. | 463/42 |
| 5,752,882 A | | 5/1998 | Acres et al. | 463/42 |
| 5,759,102 A | | 6/1998 | Pease et al. | 463/42 |
| 5,800,269 A | | 9/1998 | Holch et al. | 463/42 |
| 5,820,459 A | | 10/1998 | Acres et al. | 463/25 |
| 5,836,817 A | | 11/1998 | Acres et al. | 463/26 |
| 5,848,932 A | * | 12/1998 | Adams | |
| 5,851,147 A | * | 12/1998 | Stupak | 463/13 |
| 5,876,284 A | | 3/1999 | Acres et al. | 463/25 |
| 5,902,184 A | | 5/1999 | Bennett | 463/13 |
| 6,015,344 A | | 1/2000 | Kelly et al. | 463/16 |
| 6,068,552 A | * | 5/2000 | Walker | 463/21 |
| 6,104,815 A | | 8/2000 | Alcorn et al. | 380/251 |
| 6,106,396 A | | 8/2000 | Alcorn et al. | 463/29 |
| 6,110,041 A | * | 8/2000 | Walker | 463/20 |
| 6,149,522 A | | 11/2000 | Alcorn et al. | 463/29 |
| 6,213,877 B1 | * | 4/2001 | Walker | 463/22 |

OTHER PUBLICATIONS

Spielo Gaming International, www.spielo.com, Dec. 6, 2000.
Oracle Corporation, www.oracle.com/collateral/ent partioning fo.pdf, Feb., 1999.

* cited by examiner

*Primary Examiner*—Mark Sager
(74) *Attorney, Agent, or Firm*—Beyer, Weaver & Thomas LLP

(57) ABSTRACT

A disclosed gaming machine has a memory storing a list of one or more prizes, a prize display for viewing prize information, and a prize selection mechanism that allows a user playing a game on the gaming machine to select one or more prizes specific to one or more outcomes of the game played on the gaming machine. One or more gaming machines may be connected in a "prize distribution network" to a "prize server." The prize server may include an interface for providing prize information to the gaming machines connected in the prize distribution network and a memory storing the prize information as groups of prizes for separate display on the gaming machines. With the prize server and prize distribution network, the prizes available as an award on each gaming machine in the prize distribution network may be easily changed.

37 Claims, 7 Drawing Sheets

Figure 6A
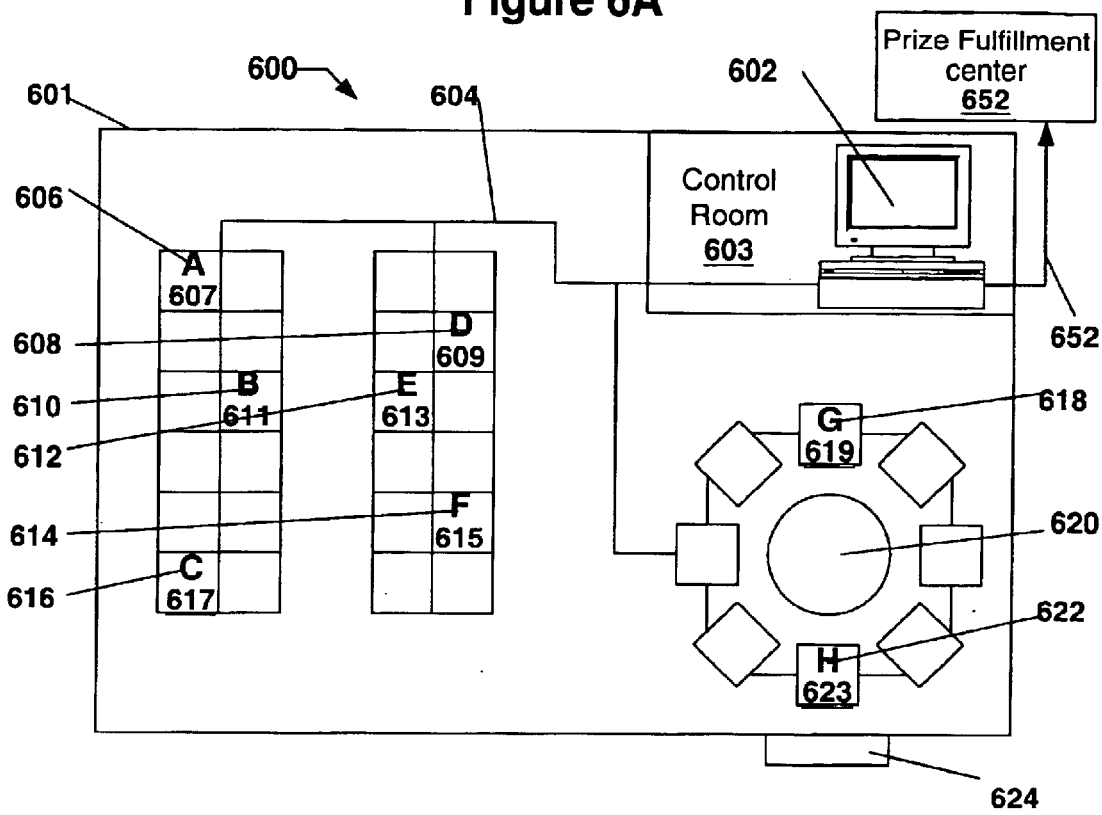
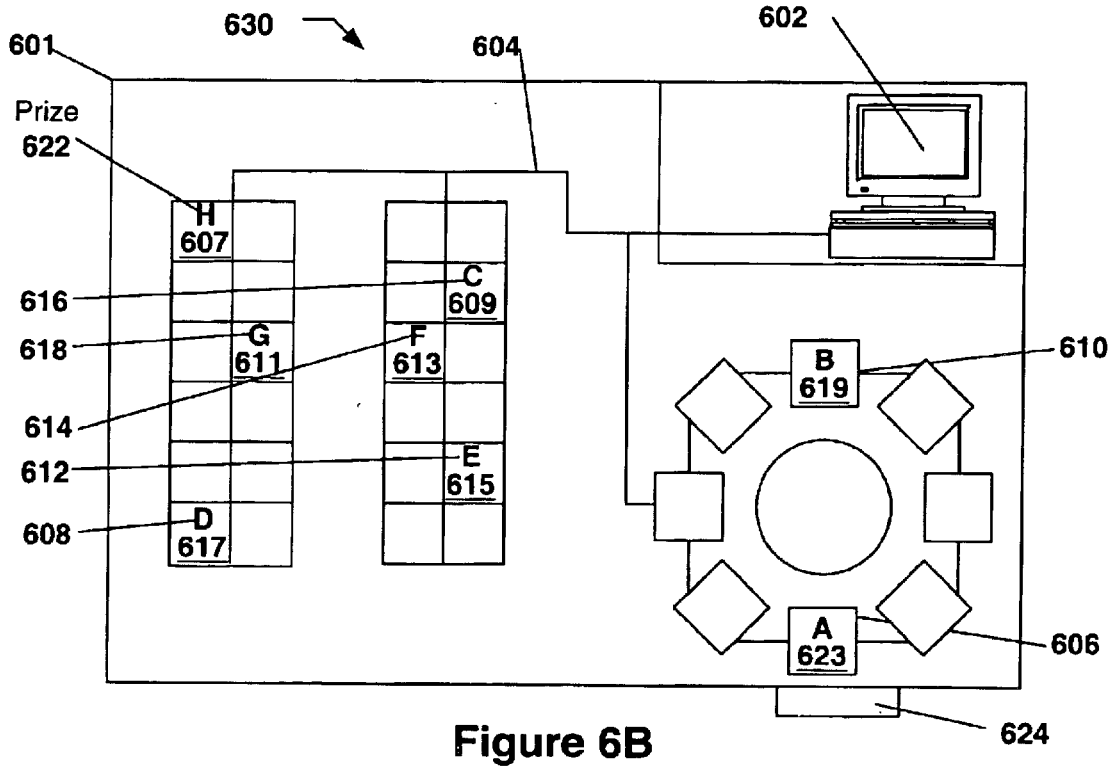
Figure 6B

NAME YOUR PRIZE GAME PLAYING METHODOLOGY

BACKGROUND OF THE INVENTION

This invention relates to game playing methods for gaming machines such as slot machines and video poker machines. More particularly, the present invention relates to methods of allowing game players to select prizes on gaming machines.

There are a wide variety of associated devices that can be connected to a gaming machine such as a slot machine or video poker machine. Some examples of these devices are lights, ticket printers, card readers, speakers, bill validators, coin acceptors, display panels, key pads, and button pads. Many of these devices are built into the gaming machine. Often, a number of devices are grouped together in a separate box that is placed on top of the gaming machine. Devices of this type are commonly called a top box. Typically, each top box is designed specifically for a game title.

Typically, the gaming machine controls various combinations of devices. These devices provide gaming features that augment the features of the gaming machine. Further, many devices such as top boxes are designed to be removable from the gaming machine to provide flexibility in selecting the game features of a given gaming machine.

An important feature of a gaming machine is a programmed pay-out table. Typically, the pay-out table relates the outcome of a game on the gaming machine to a particular prize associated with the outcome of the game. For example, a pay-out table on a slot machine might specify the required pay-out when a play results in three cherries. The pay-out can vary depending upon how many coins are played; e.g., the pay-out is 10 coins when one coin is wagered in the game, 20 coins when two coins are wagered in the game and 40 coins when three coins are wagered in the game. The pattern of relating an outcome to the pay-out, which may be a function of the wager amount, is usually displayed or described for all of the potential outcomes of a game. Often a part of a pay-out table is displayed on a gaming machine. In fact, many gaming machine features including the lights and the display panels may be utilized to draw a players attention to the pay-out table to heighten the players interest in playing a game.

The odds of a particular outcome of a game on a gaming machine may be a function of the rules of the game or may be designated by the operator of the gaming machine. For example, the odds of obtaining a certain poker hand on a video poker machine may be a known function of the possible combinations of cards in a standard 52 card playing deck. However, for a slot machine, the odds of a particular outcome of a slot game on a video or mechanical slot machine may be increased or decreased for a particular machine. The odds and pay-out usually remain fixed for a particular gaming machine so long as it is programmed to play a particular game.

For a particular game on a gaming machine, a maximum prize or pay-out will be offered. This maximum prize or jackpot will usually correspond to the outcome of a game on a gaming machine that has the lowest odds of occurring. For example, on a video poker machine, a jackpot is usually offered when the outcome of a game is a royal flush. This is because the royal flush typically has the lowest odds of occurring during a particular game of video poker. The maximum prize offered may be also a function of the wager amount. For example, on a video poker machine, a jackpot may only be offered when the outcome of a game is a royal flush and the maximum wager on a game has been made.

For a single gaming machine, the jackpot is usually cash or a particular prize. For example, for a slot machine with a maximum wager of 3 coins, the jackpot might be 5,000 coins when 3 coins are wagered on a particular game. As another example, for a video poker machine, with a maximum wager of 3 coins, the jackpot might be a car when 3 coins are wagered. Usually, the jackpot, the pay-out table and the odds for each outcome in the pay-out table are fixed on a single gaming machine and may not be changed by the player.

For multiple gaming machines linked by a network, the jackpot on a single gaming machine may vary in time. For example, the amount of money entered into a group of gaming machines can be pooled together to provide a larger jackpot for groups of gaming machines linked together as part of a wide area progressive network or a casino area network. As money is entered into an individual gaming machine, this information can be relayed over the communication network to a central location where the total amount of money in the jackpot is tracked for the group of gaming machines linked together. The information on the total jackpot, which changes with time, can be sent out over the wide area progressive network or casino area network to display signs displaying the jackpot amount. Thus, the jackpot amount for a gaming machine linked to a wide area progressive network or casino area network will increase with time until the jackpot is reset. However, the odds of winning the jackpot remain fixed.

Disadvantages of the current method for offering prizes and pay-outs on a gaming machine is that the jackpot and the odds of winning the jackpot are fixed when a player initiates a game on the gaming machine. Further not all valuable prizes are universally appreciated. Some players may be more motivated to win cash and others to win cruises or automobiles. The fixed jackpot and odds of winning the jackpot may discourage game play in certain situations. For example, when the jackpot for a slot machine is a motorcycle, some players may not play a game on the slot machine because the players are not interested in winning a motorcycle. As another example, after a jackpot is won on a group of machines linked by a wide area progressive network, the jackpot on the machines usually reverts to some minimum amount. Some players may avoid playing these gaming machines while the jackpot is small because the maximum winnings are so small. Accordingly, it would be desirable to provide a game playing methodology for gaming machines which allows a player to select the prizes or jackpot that may be won on a particular gaming machine where the odds of winning the prize or jackpot are a function of the prize selected.

Another disadvantage of the current method of offering prizes in pay-outs on a gaming machine results from the difficulty in changing the prizes associated with individual machines. Often casinos find that particular arrangements of gaming machines, each with different prizes, on the casino floor maximize play. Specifically, games may be placed in certain locations on the floor to attract customers into the casino and maximize game play on the various gaming machines. For example, a gaming machine offering a particular prize, which is popular, might be placed near the door to attract customers into the casino. In fact, the distribution of gaming machines on a casino floor is sometimes considered a proprietary secret of casinos.

Over time, what was once a very enticing arrangement becomes less interesting to players. However, play can be increased again by rearranging the layout of gaming machines on the casino floor. Unfortunately, changing the distribution of prizes on the casino floor requires that someone physically move the gaming machines to different locations. This can be a very tedious and time-consuming exercise. Accordingly, it would be desirable to provide a game playing methodology for gaming machines which allows the prizes offered on each gaming machine to be changed more easily.

SUMMARY OF THE INVENTION

This invention addresses the indicated above by providing a gaming machine having a memory storing a list of one or more prizes, a prize display mechanism for viewing prize information, and a prize selection mechanism that allows a user to select one or more prizes specific to one or more outcomes of a game played on the gaminig machine. One or more gaming machines may be connected in a "prize distribution network" to a "prize server." The prize server may include an interface for providing prize information to the gaming machines connected in the prize distribution network and a memory storing the prize information as groups of prizes for separate display on the gaming machines. With the prize server and prize distribution network, the prizes available as an award on each gaming machine in the prize distribution network may be easily changed.

One aspect of the present invention provides a gaming machine that generally can be characterized as including (1) a memory storing a list of one or more prizes, (2) a prize display mechanism displaying one or more prizes available to a user and (3) a prize selection mechanism that allows the user to select one or more prizes specific to one or more outcomes of a game played on the gaming machine. The gaming machine may be a mechanical slot machine, a video slot machine, a keno game, a lottery game, or a video poker game and the list of prizes available for selection may include merchandise, vacations, airline miles, shopping sprees and cash. In one embodiment, a probability of the outcome of the game played on the gaming machine is specific to a value of the selected prize.

In preferred embodiments, the list of prizes is stored in a memory selected from the group consisting of a EEPROM, DVD, a CD-ROM, a non-volatile memory, or a magnetic storage device. A player may select prizes using a key pad, a button panel, a touch screen, a mouse, a touch pad, a joystick, a microphone, or a magnetic card. Further, the prize selection mechanism may allow the user to select one or more prizes specific to a wager amount of the game played on the gaming machine.

In one embodiment, the gaming machine provides a display format for the one or more prizes displayed on the display mechanism where the prize display mechanism may be a printed sign, a video display screen, a bonus wheel, a video touch screen, an LCD, a back-lit glass panel or a prize. The display format may be graphical or textual. Further, the display format may indicate a feature of the prize including the value of the prize or a prize theme.

Another aspect of the invention provides a prize server that can be generally characterized as including (1) an interface for providing prize information to one or more gaming machines and (2) a memory storing the prize information as groups of prizes for separate display on the one or more gaming machines. The prizes may be merchandise, vacations, airline miles, shopping sprees and cash. In preferred embodiments, the interface is a fiber optic cable, a coaxial cable, or a wireless interface, the display is a video display screen, a touch screen, or a LCD, and the memory is a CD-ROM, a non-volatile memory, or a magnetic storage. Further, the prize server may include a second interface to an output mechanism including a printer, an optical card reader, a smart card reader, a mechanism for electronically crediting a pre-existing account or a magnetic card reader.

Another aspect of the invention provides a prize distribution network that can be generally characterized as including (1) a prize server and (2) a plurality gaming machines. As described above, the prize server should include an interface for providing prize information to one or more gaming machines and a memory storing the prize information as groups of prizes for separate display on the one or more gaming machines. Each gaming machines preferably includes (a) a memory storing a list of one or more prizes and a prize display mechanism displaying one or more prizes and (b) a prize selection mechanism that allows a user to select one or more prizes specific to one or more an outcomes of a game played on the gaming machine. In preferred embodiments, the gaming machine may be a mechanical slot machine, a video slot machine, a keno game, a lottery game, or a video poker game and the prizes are merchandise, vacations, airline miles, shopping sprees and cash.

Another aspect of the invention provides a method of selecting a prize specific to an outcome of a game played on a gaming machine, the method may be characterized as including the following steps (1) displaying multiple prizes available for selection in the prize display mechanism (2) receiving an input signal from the prize selection mechanism for selecting a prize from the list of prizes where the input signal corresponds to a user's selection of the selected prize (3) receiving a game play signal and determining the game play outcome (4) presenting the game play and game play outcome. In preferred embodiments, the method may include one or more of the following steps (a) receiving a wager amount prior to receiving an input signal from the prize selection mechanism and (b) displaying a group of prizes available for selection in the prize display mechanism specific to the wager amount (c) determining a pay table to be used in determining a game play outcome where the play table is chosen according to the value of the selected prize (d) outputting the selected prizes to a portable memory device where the portable memory device is a paper printout, a magnetic card or a smart card, or any portable storage devices.

Another aspect of the present invention provides a method for distributing information about prizes available on specific gaming machines that may be generally characterized as including the following steps (1) establishing communication with each gaming machine connected to the prize server and (2) sending prize information from a memory on the prize server to a memory on each gaming machine where the prize information is specific to prizes which are available for selection by game players as game awards on games played on the gaming machines. In preferred embodiments, the method may include one or more of the following steps, (a) displaying the prize information to a video display screen associated with one or more of the gaming machines (b) identifying one or more prizes selected by a user and (c) comprising outputting the selected prize information to a portable storage device, which can be read by one or more of the gaming machines.

These and other features of the present invention will be presented in more detail in the following detailed description of the invention and the associated figures.

BRIEF DESCRIPTION OF THE DRAWINGS

FIGS. 6A and 6B are block diagrams depicting a casino floor having gaming a machines in a fixed physical arrangement, in which the distribution of prize groups on the gaming machines is varied using a prize server network for one embodiment of the present invention.

DESCRIPTION OF THE PREFERRED EMBODIMENTS

Figure 1:
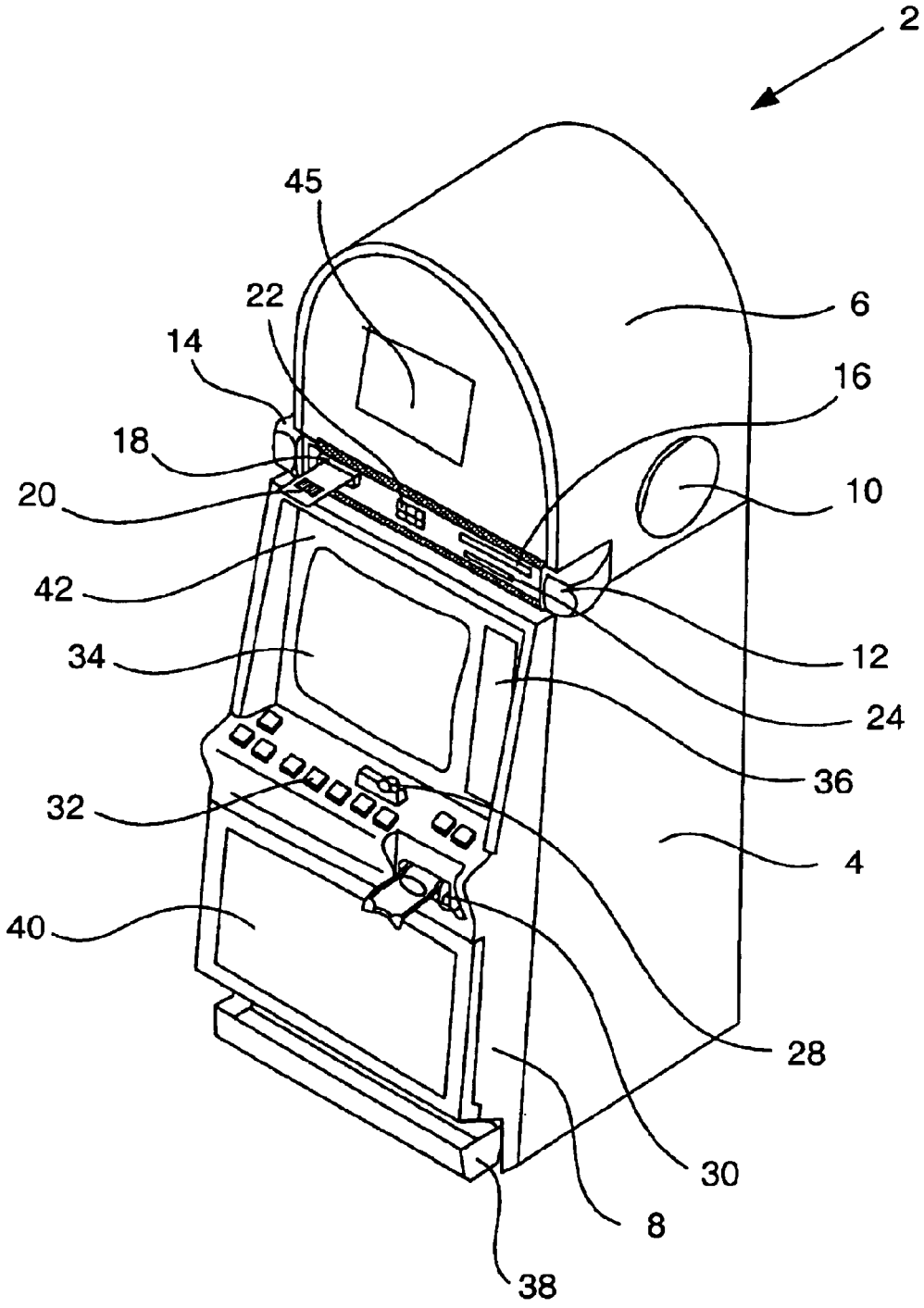
FIG. 1 is a perspective drawing of a gaming machine having a top box and other devices.

Tuning first to FIG. 1, a video gaming machine 2 of the present invention is shown. Machine 2 includes a main cabinet 4, which generally surrounds the machine interior (not shown) and is viewable by users. The main cabinet includes a main door 8 on the front of the machine, which opens to provide access to the interior of the machine. Typically, the main door 8 and/or any other portals which provide access to the interior of the machine utilize a locking mechanism of some sort as a security feature to limit access to the interior of the gaming machine. Attached to the main door are player-input switches or buttons 32, a coin acceptor 28, and a bill validator 30, a coin tray 38, a belly glass 40, and a monitor mask 42. Viewable through the main door is a video display monitor 34 and an information panel 36. The display monitor 34 will typically be a cathode ray tube, high resolution flat-panel LCD, or other conventional electronically controlled video monitor. Further, the video display monitor 34 may include a touch screen. The touch screen may respond to inputs made by a player touching certain portions of the screen. The information panel 36 is a back-lit, silk screened glass panel with lettering to indicate general game information including, for example, the number of coins played. The bill validator 30, player-input switches 32, video display monitor 34, and information panel are devices used to play a game on the game machine 2. The devices are controlled by circuitry (not shown) housed inside the main cabinet 4 of the machine 2. Many possible games, including traditional slot games, video slot games, video poker, keno, and lottery, may be provided with gaming machines of this invention.

The gaming machine 2 includes a top box 6, which sits on top of the main cabinet 4. The top box 6 houses a number of devices, which may be used to add features to a game being played on the gaming machine 2, including speakers 10, 12, 14, a glass panel with display lamps 16, a ticket printer 18 which prints bar-coded tickets 20, a key pad 22 for entering player tracking information, a florescent display 24 for displaying player tracking information, a card reader 26 for entering a magnetic striped card or a smart card containing player tracking information, and a video display screen 45. Further, the top box 6 may house different or additional devices than shown in the FIG. 1. For example, the top box may contain a bonus or prize reel which may be used to add bonus features to the game being played on the gaming machine. During a game, these devices are controlled, in part, by circuitry (not shown) housed within the main cabinet 4 of the machine 2. The top box 6 is designed to be removable from the machine 2. Typically, the top box 6 is replaced to repair a device within the top box 6 or to install a new top box 6 with a different set of devices and game features.

Understand that gaming machine 2 is but one example from a wide range of gaming machine designs on which the present invention may be implemented. For example, not all suitable gaming machines have top boxes or player tracking features. Further, some gaming machines have two more game displays—mechanical and/or video. And, some gaming machines are designed for bar tables and have displays that face upwards. Those of skill in the art will understand that the present invention, as described below, can be deployed on most any gaming machine now available or hereafter developed.

Returning to the example of FIG. 1, when a user wishes to play the gaming machine 2, he or she inserts cash through the coin acceptor 28 or bill validator 30. At the start of the game, the player may enter playing tracking information using the card reader 26, the keypad 22, and the florescent display 24. Further, other game preferences of the player playing the game may be read from a card inserted into the card reader. During the game, the player views game information using the video display 34. Other game and prize information may also be displayed in the video display screen 45 located in the top box.

During the course of a game, a player may be required to make a number of decisions, which affect the outcome of the game. For example, a player may vary their wager on a particular game, select a prize for a particular game, or make game decisions which affect the outcome of a particular game. The player may make these choices using the player-input switches 32, the video display screen 34 or using some other device which enables a player to input information into the gaming machine. During certain game events, the gaming machine 2 may display visual and auditory effects that can be perceived by the player. These effects add to the excitement of a game, which makes a player more likely to continue playing. Auditory effects include various sounds that are projected by the speakers 10, 12, 14. Visual effects include flashing lights, strobing lights or other patterns displayed from lights on the gaming machine 2 including lights behind the front glass 16 on the top box 6 or from lights behind the belly glass 40. After the player has completed a game, the player may receive game tokens from the coin tray 38 or the ticket 20 from the printer 18, which may be used for further games or to redeem a prize. Further, the player may receive a ticket 20 for food, merchandise, or games from the printer 18.

Figure 2:
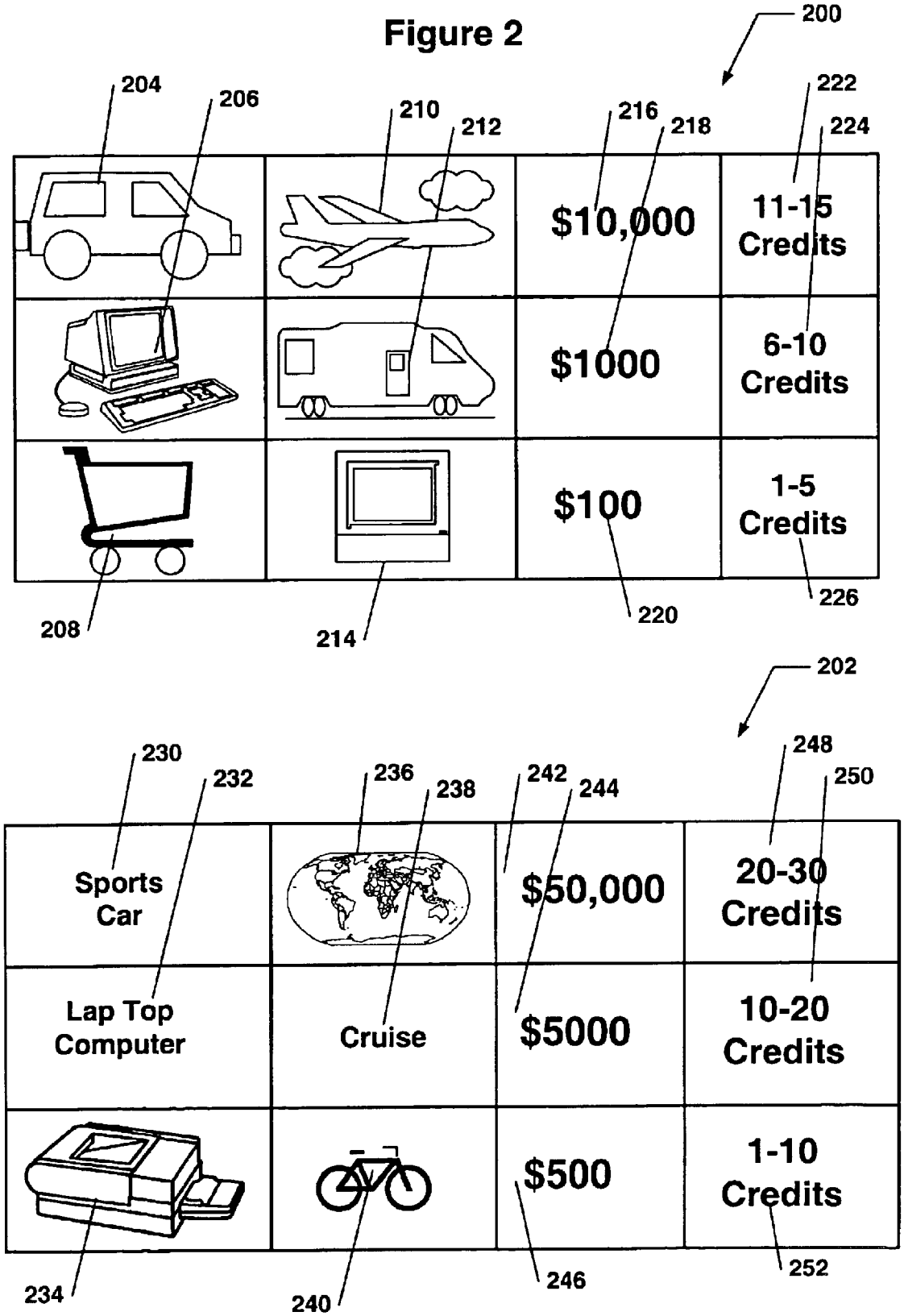
FIG. 2 is a block diagram depicting examples of prizes in a tabular prize display format.

FIG. 2 is a block diagram depicting examples of prizes in a tabular prize display format. A prize selection table 200 is a list of prizes displayed in a tabular formal. A second prize selection table 202 shows an alternative list of prizes. Typically only a single prize selection table will be displayed for a single gaming machine prior to any play.

Each of the prize selection tables 200 and 202 contains a number of a prizes which a player may select as an award or pay-out when a certain outcome occurs during the course of a game being played on a gaming machine. For example, a player may select a prize, which may be won when a jackpot or maximum pay-out occurs during a slot game, video poker game, keno game or lottery game. Using one of the prize selection tables 200 or 202, a player may select prizes when an initiating a game on the gaming machine. One or more prize selections may be made for a particular game on the gaming machine including 1) selecting an individual prize for a particular game outcome including a jackpot or some other game outcome, 2) selecting a table containing a series of prizes corresponding to a number of game outcomes, or 3) selecting multiple prizes corresponding to multiple game outcomes.

The prize selection tables 200 and 202 may be presented to a player using a number of display methods including using a video display screen on the gaming machine, using a printed copy displayed on or near the gaming machine, using a back-lit glass panel attached to the gaming machine, using a display screen viewable by players playing a game on a gaming machine but not attached to the gaming machine, using a carousel displaying a number of actual prizes, or using a bonus reel with graphical or textual representations of prizes. One or more combinations of prize display methods may be used by a player for prize selection. For example, the prize selection tables 200 and 202 might be displayed on a video display screen on the gaming machine, on a printed sign on or near the gaming machine, or on a silk screen glass display panel incorporated into the main cabinet of the gaming machine. The display format is not limited to the format of prize selections tables 200 and 202. The prize selection table may be presented in any manner that allows a player to select from a list of one or more prizes. Further, prizes may be listed in a graphical or textual manner.

Usually, the prize selection process begins before a game play has been initiated on the gaming machine. A player viewing a prize selection table, 200 or 202, displayed on or near the gaming machine using a prize display method some type may select one or more prizes connected to one or more game outcomes, including a jackpot for a slot machine or a royal flush for a video poker machine, from a list of prizes presented. For example, a player might chose as a prize for a jackpot from the group consisting of a compact car 204, a computer 206, a shopping spree 208, a plane trip 210, a camping trip 212, a television 214 or cash 216, 218, 220 from prize table 200. As another example, a player may chose as a prize for a jackpot a sports car 230, a lap-top computer 232, a computer printer 234, a trip around the world 236, a cruise 238, a bicycle 240 or cash 242, 244, 246. In the prize selection tables 200 and 202, the prizes are presented both graphically and textually. For example, the airplane trip 210 is represented graphically by a picture of a plane and clouds while the sports car 230 is represented textually. Obviously, the designer may chose to display the individual prizes in any manner that he or she chooses.

The prizes or cash amounts are not always limited to the individual prizes and cash amounts presented in prize selection table 200 and prize selection table 202. The prize tables may combine many different combinations of prizes, rewards and cash amounts that may encourage game play on a gaming machine and add excitement to a game being played on the gaming machine. For example, prize selection tables may present prizes based on a theme which may interest a player including vacations, cars, computers, motorcycles or other merchandise. As another example, a player may be able to select other awards or benefits including airline miles on a particular airline for a game outcome on a gaming machine. Still further, the different game outcomes might correspond to different available prizes. For example, in a video poker game, a royal flush might award a sports car, four of a kind might award a motorcycle, and a full house might award a bicycle.

The type of prize, cash amount or reward a player may select from a prize selection table including prize selection table 200 and prize selection table 202 may be linked to the wager amount for the game that has been initiated on the gaming machine. For example, in prize selection table 200, the shopping spree 208, the television 214, or the cash 220 may be selected when a wager of 1–5 coins or "credits" 226 has been made prior to the initiation of the game on the gaming machine. The computer 206, the camping trip 212, or the cash 218 may be selected when a wager of 6–10 coins or "credits" 224 has been made. The compact car 204, the plane trip 210 or cash 216 may be selected when a wager of 11–15 coins or credits 222 has been made.

As suggested by this discussion, the amount of the wager needed to select one or more prizes presented in a prize selection table or some other prize display format may be linked to the value of the prize. As a further example, in prize selection table 202, a wager of "20–30 credits" 248 may allow a prize to be selected from the group consisting of the sports car 230, the around the world trip 236 or the cash 242. A wager of "10–20 credits" 250 may allow a prize to be selected from the group consisting of the lap top computer 232, the cruise 238, or the cash 244. A wager of "1–10 credits" 252 may allow a player to select from the group of prizes consisting of the computer printer 234, the bicycle 240, or the cash 246. In this example, the prize values of the sports car 230, the around the world trip 236 or the cash 242 are greater than the prize values of the lap top computer 232, the cruise 238, or the cash 244. Further, the prize values of the lap top computer 232, the cruise 238, or the cash 244 are greater than the prize values of the computer printer 234, the bicycle 240, or the cash 246. Thus, in the prize selection table 202, the value of the prizes that may be selected when a particular wager is made increases as the wager amount increases. Generally, the value of the prizes available for selection will increase as the value of the wager amount increases. Of course, some embodiments of this invention do not require that a player play more coins or credits to pursue the most valuable prizes. The multi-range examples of FIG. 2 are presented for the sake of illustration only.

In another embodiment of this invention, the number of prizes that may be selected increases as the amount of the wager is increased. For example, in the prize selection table 202, when a player wagers 1–10 credits, a player may select one prize from the "1–10" credits row 252 including the printer 234, the bike, or the cash 246. When a player wagers 10–20 credits, a player may select two prizes, one prize from the "10–20" credits row 250 including the cash 244, the cruise 238 and the lap-top computer 232 and one prize from the "1–10" credits row 252. Thus, after wagering 10–20 credits, a player may select the cruise 238 and the cash 246 as prizes. When a player wagers 20–30 credits, a player may select three prizes, one prize from the "2030" credits row 248 including the sports car 230, the world trip 236, and the cash 242, one prize from the "10–20" credits row 250, and select one prize from the "1–10" credits row 252. Thus, after wagering 20–30 credits, a player may select the world trip 236, the cash 244, and the bike 240. The multi-range examples of FIG. 2 are presented for the sake of illustration only.

The odds of winning a prize selected from the prize selection table or another list of prizes displayed in an alternate display format may vary as a function of the prize selected. For example, in prize selection table 202, the odds of winning a bicycle 240 may be greater than the odds of winning a sports car 230. Thus, the prize selection process may allow a player to select a prize which has greater or lower probability of occurring for a particular game outcome of a game played by the player on the gaming machine. The odds of winning a particular prize typically are not chosen by the player. In a prize selection table or in a list of prizes displayed in some other display format, the odds of winning certain prizes may be presented in a relative manner so that a player can ascertain whether the probability of winning a particular prize is higher or lower relative to another prize. The odds of each outcome of a game are usually stored in the gaming machine in the form of a "pay table." When the pay table of a game is adjustable (e.g. slot games) the odds of winning a particular prize will typically decrease as the value of the prize increases.

Figure 3:
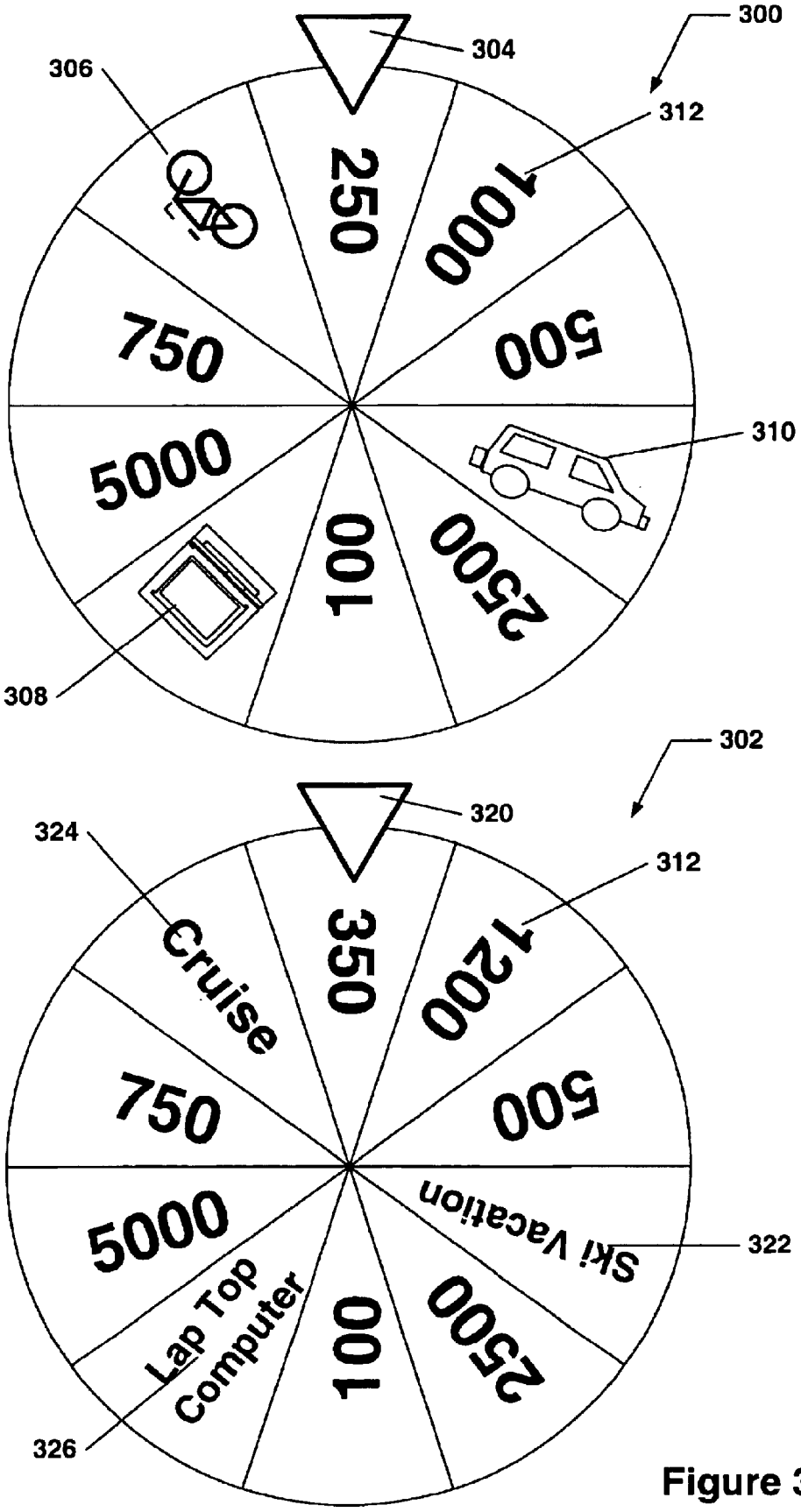
FIG. 3 is a block diagram depicting examples of prizes in a circular or "wheel" prize display format.

FIG. 3 is a diagram depicting examples of prizes in a circular or "wheel" shaped prize display format. The circular prize selection tables 300 and 302 are divided into wedges such that different prizes may be displayed in each wedge. The circular prize selection tables 300 and 302 may be displayed using a number of display methods including a including using a video display screen on the gaming machine, using a printed copy displayed on or near the gaming machine, using a back-lit glass panel attached to the gaming machine, using a display screen viewable by players playing a game on a gaming machine but not attached to the gaming machine, or using a bonus reel with graphical or textual representations of prizes.

The circular prize selection tables 300 and 302 are incorporated as part of a mechanical or video bonus reel in one embodiment of the present invention. A mechanical bonus reel might be comprised of a wheel with a circular prize selection table 300 or 302 mounted on the wheel such that the prizes are viewable by a player playing a game on the gaming machine. A player may select a prize on the circular prize selection tables 300 and 302 by inputting commands into the gaming machine in some manner that cause a motor or some other device connected to the mechanical bonus reel to rotate to a certain a position. Alternatively, the player may manually adjust the wheel position to select the desired prize. When the wheel is rotated to a position under the prize selector 304, a player has selected the prize contained within the wedge under the prize selector 304. For example, by inputting commands that rotates the bonus reel, the player might select the bicycle 306, the television 308, the car 310 or the cash 312 to correspond to the outcome of a game event when the game is played. As described above in reference to FIG. 2, the prize selected from the prize selection table may be linked to the outcome of a game event including a jackpot for a slot machine or a royal flush for a video poker game. Further, the prizes available for selection from the circular prize selection tables may be limited by the amount of the wager for a particular game. Also, the probability of winning a particular prize in the prize the selection table may be different for different prizes.

For a mechanical implementation of the circular prize selection table as part of a prize reel for one embodiment of the present invention, the available prize selection might be altered by replacing individual wedge pieces within the circular prize selection table. For example, the wedge containing a bicycle prize 306 in the circular prize selection table 300 could be replaced with a wedge containing a cruise prize 324. As another example, the entire wheel containing the circular prize selection table 300 could be replaced with another entire bonus wheel containing the circular prize selection table 302. The prizes on a wedge can be represented in either textual formats or graphical formats. For example, a car 310 in the circular prize selection table 304 is presented graphically while the cruise in the circular prize selection table 306 is presented textually.

In one embodiment of the invention, the circular prize selection table might be implemented for presentation on a video display on or near the gaming machine. For example, a player might select a prize from the circular prize selection table 302 by inputting commands to the gaming machine that rotate a video presentation of the circular prize selection table 302 under the prize selector 320. Thus, a player might select a prize from the group consisting of the cruise trip 324, the ski vacation 322, the lap top computer 326 or the cash 322. A player might input commands into the gaminig machine to rotate the bonus wheel and select a prize from the circular prize selection table 302 using one or more input devices on the gaming machine including a touch screen device, a mouse, a touch pad, joystick, a microphone connected to voice recognition technology or input buttons.

Figure 4:
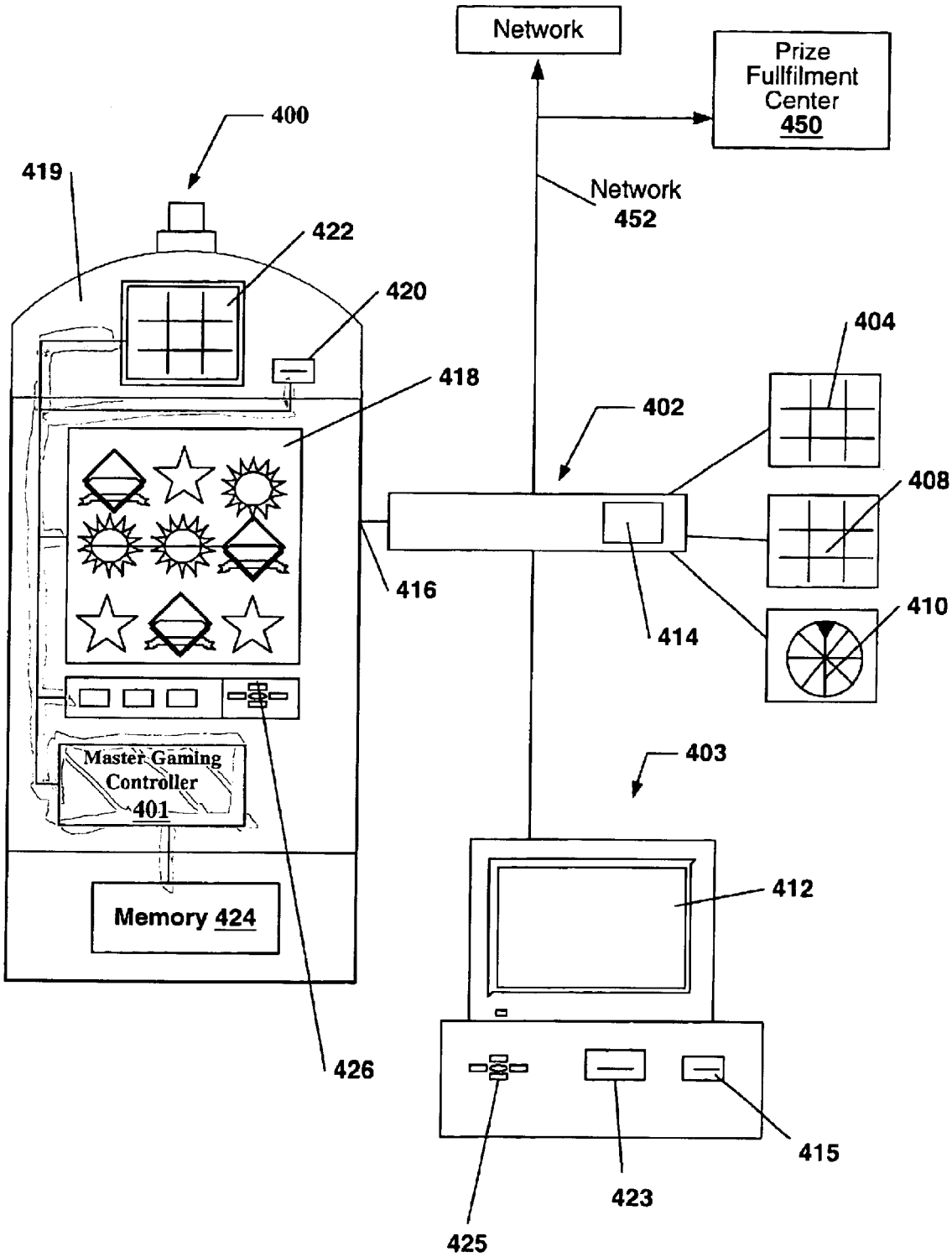
FIG. 4 is a block diagram depicting a gaming machine and a prize server.

FIG. 4 is a block diagram depicting a gaming machine and a prize server. The depicted prize server 402 includes a memory storage device 414 storing a database of prizes and a means of accessing and communicating prize information. The prize server 402 might be located within the gaming machine 400 or in a location physically separate from the gaming machine. A prize server typically serves groups of prizes to various gaming machines in a casino. The casino or a user may select a group of prizes to be made available for selection specific machines. The prizes stored for serving may be grouped by theme, relative value, diversity, and the like. Three different prize groups 404, 408, and 410 are depicted as being stored in device 414 (and thereby made available for serving to individual gaming machines).

As described with reference to FIGS. 2 and 3, the list of prizes available for selection from the prize server 402 may be displayed in various formats including graphical lists, textual lists or combination of both graphic and textual lists. For example, in one embodiment of the present invention, the prizes are presented in the display format of prize selection table 404 where the prize selection table is organized as a square grid as described above with reference to FIG. 2. Prize information from the prize server 402 including the prize selection table 404 may be displayed on a video display screen 412 or any other display device that is in communication with the prize server. In another embodiment of the present invention, the prize display format 410 is organized as a circular grid as described above with reference to FIG. 3 and may be displayed on the video display screen 412. Note that actual format of the displayed prize groups may be controlled by the individual gaming machines, rather than the prize server. In such cases, the server merely provides lists of prizes and associated values. In either case, the gaming machine will typically supply the appropriate pay tables for the individual prizes that may be selected.

As mentioned, the prizes stored in the memory storage device 414 of the prize server 402 may be presented or sorted according to various themes or combinations of themes. For example, the prize selection table 404 might contain a list of cruises that are presented according to the value of the prizes, the prize selection table 408 might contain a list of cars that are presented according to the manufacturer of the car and the circular prize selection table 410 might contain a list of vacations that are presented according to the location. The prizes available from the prize server might be changed by modifying the information stored within the memory storage device 414. For example, a list of prizes might be stored on a CD-ROM which is readable by the prize server 402. The contents of such CD-ROM or other portable storage device might be temporarily or permanently stored in the memory storage device 414 or downloaded from another secured server via a network. The available prizes on the prize server 402 might be changed by inserting a new CD-ROM into the memory storage device 414. In other embodiments, lists of prizes might be stored on an EEPROM, a non-volatile memory, a DVD, a floppy disk, a hard drive or some other means of information storage which may be modified in some manner to change the available prizes.

The prize selection process could be carried out in a number of ways. In a preferred embodiment, the casino or gaming machine vendor or service organization utilizes a protocol that downloads selected groups of prizes from the server 402 to the gaming machine 400. In a network environment, the server could be controlled through a terminal 403 (e.g., a PC). In some cases, terminal 403 is provided in a different location from the gaming machine but connected to the prize server 402 which may be located within the gaming machine or in a location physically separate from the gaming machine. Lists of prizes are displayed, possibly in the same display formats that they will be presented to the user at the gaming machines. For example, available groups of prizes may be displayed on terminal 403 as prize selection tables, 404, 408 and 410. The network operator selects desired groups of prizes and associated gaming machines using suitable user interfaces such as keyboards, mice, touch screens, and the like.

In an alternative embodiment of the present invention, a player has direct access to terminal 403, which may be configured as a "prize kiosk." The prize groups may be viewed by the player on a touch screen 412. Also, the prizes could be viewed on a video display screen without touch screen capabilities. The different prizes presented are viewed, searched and selected using the touch screen 412, prize selection inputs 425 or combinations of both the touch screen and the prize selection inputs. When a player has chosen one or more prizes or combinations of prizes, the prize information may be stored on a magnetic card or smart card inserted into the card reader 415 or a printed prize sheet from the printer 423. Other output mechanisms may be used to output prize information to a storage device including an optical card reader, a smart card reader, a personal digital assistant or a mechanism for electronically transferring data to a player's pre-existing account such as a connection to remote account server. To play for one or more of the selected prizes, a player inserts the magnetic card or smart card containing the prize information into the card reader 420 on the gaming machine 400 or inputs prize information into the gaming machine using the prize selection inputs 426. The prize information containing the selected prizes might be read and displayed on the display screen 422 or some other display device on the gaming machine. When the player initiates a game, the gaming machine selects the appropriate pay table for the prize or prizes selected and presents a game outcome to the player in the display area 418. The pay tables corresponding to different prizes and may be stored in a memory location 424 residing within the gaming machine 400. This may also be configured on a master gaming controller 401 of the gaming machine 400. When a specific outcome of a game occurs corresponding to a pay-out of the selected prize, the player wins the selected prize. An advantage of acquiring prize information on a terminal separate from the gaming machine is that a large number of prizes may be searched without using valuable game playing time searching for a gaming machine having the prizes desired by a player.

In another embodiment of the present invention, a player selects prizes from a display terminal connected directly to the gaming machine. For example, prizes available for selection might be displayed on the display screen 422 located within the top box 419 or on the display screen 418 located on the main cabinet of the gaming machine 400. A list of available prizes or prize groups might be obtained from the prize server 402 which may be located within the gaming machine 400 or may be physically separate from the gaming machine. After initiating a game by inputting a wager into the gaming machine 400, a player might preselect a prize from the list of prizes available and begin game play. As described above, when a game play is initiated by the player, the gaming machine selects the appropriate pay table for the prize or prizes selected and presents a game outcome to the player in the display area 418. As mentioned, the pay tables corresponding to different prizes and may be stored in a memory 424 or configured on the master gaming controller 401 of gaming machine 400. When a specific outcome of a game occurs corresponding to a pay-out of the selected prize, the player wins the selected prize.

In one embodiment, the prize server 402 may be connected to a prize fulfillment center 450. Thus, when a player wins a specific prize on the gaming machine 400, the prize information is sent from the gaming machine to the prize server 402. Then, the prize information is sent over a network 452 to the prize fulfillment center 450. The purpose of the prize fulfillment center is to acquire and transfer the prize won by the player to the player. For example, when a player wins a computer, the prize fulfillment center might order the computer from a vendor and have it shipped to the player's home address. As another examplc, the prize fulfillment center might send a request to a nearby warehouse and have the prize delivered to a location in the casino where the player can pick up the prize.

Figure 5:
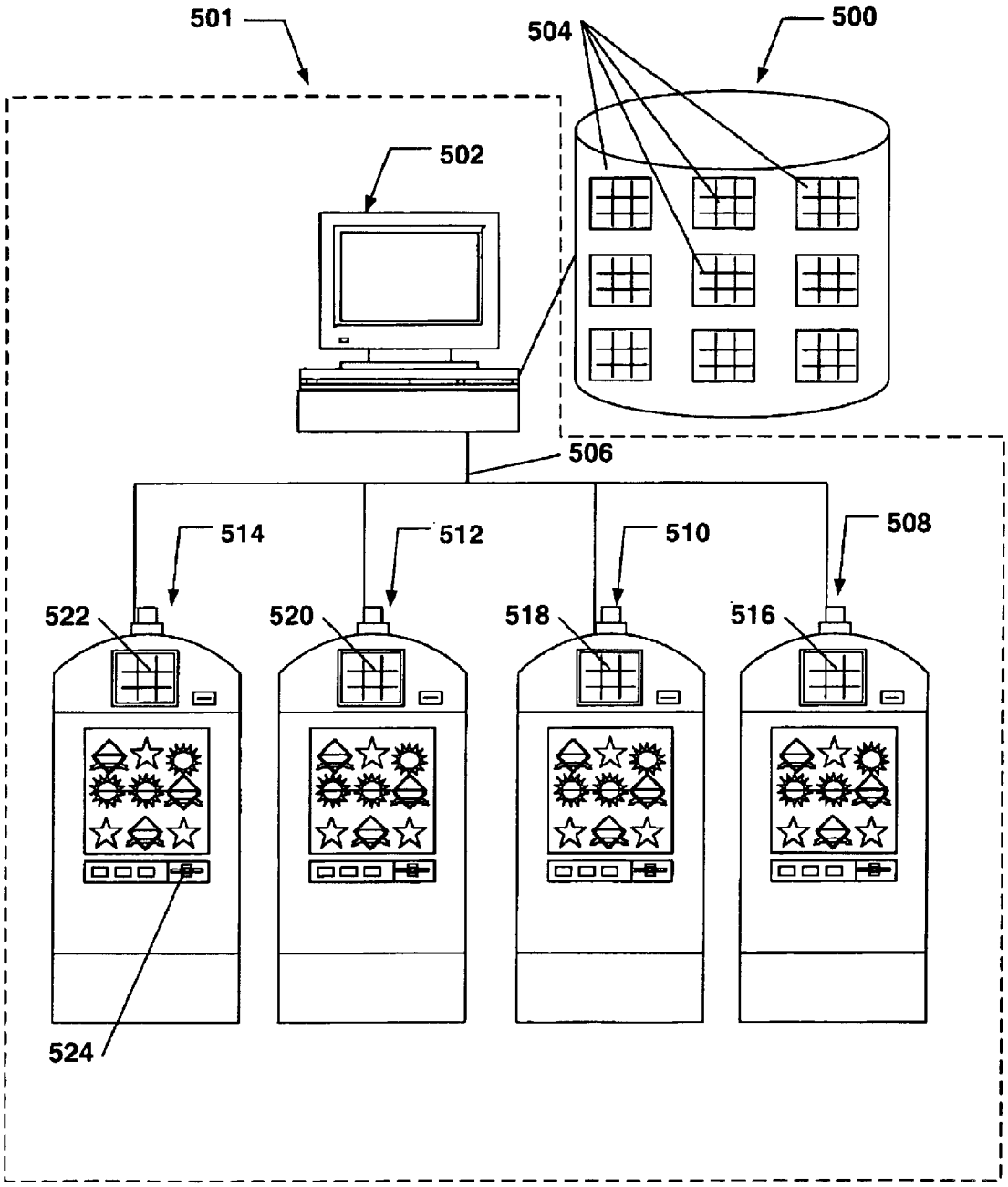
FIG. 5 is a block diagram depicting a group of gaming machines connected to a prize server in a prize distribution network for one embodiment of the present invention.

FIG. 5 is a block diagram depicting a group of gaming machines connected to a prize server in a prize distribution network for one embodiment of the present invention. The prize distribution network is comprised of a prize server connected to a plurality of gaming machines. In FIG. 5, a prize server 502 is connected to four gaming machines, 508, 510, 512, and 514, representative of a typically larger group. The network connection 506 between the prize server and the gaming machines may be implemented using a fiber optic link, copper wire (e.g., coaxial line), a wireless link or some other suitable connection means. Communication may take place via any suitable protocol or group of protocols such as USB, Ethernet, TCP/IP and the like. The depicted prize server 502 contains a database 500 containing lists of prizes. The list of prizes stored in the database may be accessible in various groupings. For example, the prizes may be stored and accessed in some manner corresponding to the prize selection tables 504 as described with reference to FIGS. 3 and 4. Further, the lists of prizes stored in the database 500 may be stored and accessed in groups according to various themes including vacations, merchandise, or value.

With a prize distribution network 501, prize groups available on each gaming machine might be replaced by downloading prize information from the prize server 502 to the various individual gaming machines in the prize distribution network. One goal of a network system such as that depicted in FIG. 5 is to allow a casino or other entity to vary the distribution of available prizes over its various installed gaming machines. To present a "new look," a casino may download prizes from the prize server 502 so that the gaming machine 508 has car prizes available for prize selection which are displayed on the video display 516, the gaming machine 510 has vacation prizes available for prize selection which are displayed on the video display 518, the gaming machine 512 has computer prizes available for prize selection which are displayed on the video display 520, and the gaming machine 514 has ski prizes available for prize selection which are displayed on the video display 522. The list of prizes stored on each gaming machine is typically stored on prize server 502.

As described in reference to FIGS. 2, 3, 4, 5, a player desiring to play a game for a particular prize on a given gaming machine might select the prize by using prize selection inputs 524 located on the gaming machine. Depending on the popularity of a given a prize, the prizes available on the gaming machines in the prize distribution network 501 might be changed. For example, when the ski prizes available on gaming machine 514 are popular, ski prizes may be downloaded from the prize server 502 on the gaming machines 508, 510, and 512. As another example, when the car prizes available on gaming machine 508 are popular, car prizes may be downloaded from the prize server 501 to the gaming machines 510, 512 and 514. Typically, the types of prizes available on a particular gaming machine are determined by the operator of the gaming machine.

The redistribution of prizes on the gaming machines with a prize selection capability does not necessarily require a prize distribution network. For example, each gaming machine 508, 510, 512, 514, might contain a prize server with a CD-ROM, EEPROM, non-volatile RAM, DVD or some other memory storage device. The prize information is stored within the memory storage device. The prizes available on each gaining machine might be changed by inputting new prize information into the memory storage device or exchanging the memory storage device. As another example, each gaming machine might be connected to a top box with a prize selection display including a bonus reel. The prize distribution on various gaming machines might be changed be exchanging the top box on each gaming machine with a second top box displaying a different set of prizes than the first top box on the gaming machine.

FIGS. 6A and 6B are block diagrams depicting an example of a casino floor with a single fixed arrangement of gaming machines, but different prize group distributions across those gaming machines. The different distributions are programmed using a prize server network in one embodiment of the present invention. A prize server 602 is connected to a number of gaming machines via a prize distribution network 604, which may be part of a casino area network. The gaming machines, represented by square blocks, are located at various locations on a casino floor 601. For example, a gaming machine 622 is located near a door 624 which provides access to the casino floor 601. The gaming machine 622 is also near a prize carousel 620. The prize carousel 620 is typically a circular platform displaying one or more prizes. For example, a car, motorcycle, boat or other merchandise might be displayed on the carousel. The gaming machine 607 is located in the back corner of the casino floor 600. The prize server 602 is located in a separate room 603, which has limited access from the casino floor 601. A number of the gaming machines are displaying prizes. In FIG. 6A, he distribution of different prizes on the gaming machines is a casino floor prize plan 600. In this example, the gaming machine 607 is displaying prize "A" 606, the gaming machine 609 is displaying prize "D" 608, the gaming machine 611 is displaying prize "B" 610, the gaming machine 613 is displaying prize "E" 612, the gaming machine 615 is displaying prize "F" 614, the gaming machine 617 is displaying prize "C" 616, the gaming machine 619 is displaying prize "G" 618, and the gaming machine 622 is displaying prize "H" 622. The textual or graphical representations of the prizes may displayed on a video screens, touch screens, LCDs, or other display panels located on or near the gaming the gaming machine. For example, when prize "A" 606 is a car, a picture or movie of a car might be displayed on a video screen attached to the gaming machine 607 or on a video screen hanging above the gaming machine 607. The car prize might be won by a player playing a game on the gaming machine 607.

The casino floor prize plan 600 might be changed by downloading new prizes from the prize server to each gaming machine in communication with the prize server 602. After a communication link is established with the remote prize server 602, new prizes might be downloaded into gaming machines, which might be displayed on display mechanisms on or near each gaming machine. This process might be implemented by operators of the casino to increase traffic into the casino and to maximize game play on the gaming machines on the casino floor. For example, for a casino floor prize plan 630 shown in FIG. 6B, when the prize "A" on gaming machine 606 is very popular, the prize "A" 606 might be offered on gaming machine 623, which is close to the door 624, to draw game players into the casino. The changing of the prize offered on gaming machine 623 from prize "H" 622 in the casino floor plan 600 to prize "A"606 in casino floor plan 630 might be accomplished by downloading the prize "A" information onto gaming machine 623 using the prize server 602. This process might be repeated to change the casino floor prize plan 630 from casino floor prize plan 600 where the gaming machine 607 is displaying prize "H" 622, the gaming machine 609 is displaying prize "C" 616, the gaming machine 611 is displaying prize "G" 618, the gaming machine 613 is displaying prize "F" 614, the gaming machine 615 is displaying prize "E" 612, the gaming machine 617 is displaying prize "D" 608, the gaming machine 619 is displaying prize "B" 610, and the gaming machine 623 is displaying prize "A" 606. An advantage of this prize server game playing methodology is that the location of prizes on the casino floor might be redistributed much faster than physically moving each of the gaming machines.

In another embodiment, the central prize server game playing methodology may be used to change the distribution of prizes on a casino floor without employing a remote prize server. When no central prize server is available, the prizes offered on a gaming machine may be changed by changing the prize information stored in each gaming machine. For example, the prize information and prizes offered on a gaming machine that reads a CD-ROM might be changed by changing the CD-ROM in the gaming machine. This is a rather tedious process. A central prize server as illustrated in FIGS. 6A and 6B can instead allow a casino to completely change the "look" of its floor by having an operator reconfigure the gaming machines without ever visiting them.

As part of the prize distribution network 602, the prize server 602 may be connected to a prize fulfillment center 650 via a network 652 as described with reference to FIG. 4. Thus, when a player wins a specific prize on one of the gaming machines, the prize information is sent from the gaming machine to the prize server 602 and over a network 652 to the prize fulfillment center 650. The purpose of the prize fulfillment center is to acquire and transfer the prize won by the player to the player. For example, when a player wins a computer, the prize fulfillment center might order the computer from a vendor and have it shipped to the player's home address. As another example, the prize fulfillment center might send a request to a nearby warehouse and have the prize delivered to a location in the casino where the player can pick up the prize.

Figure 7:
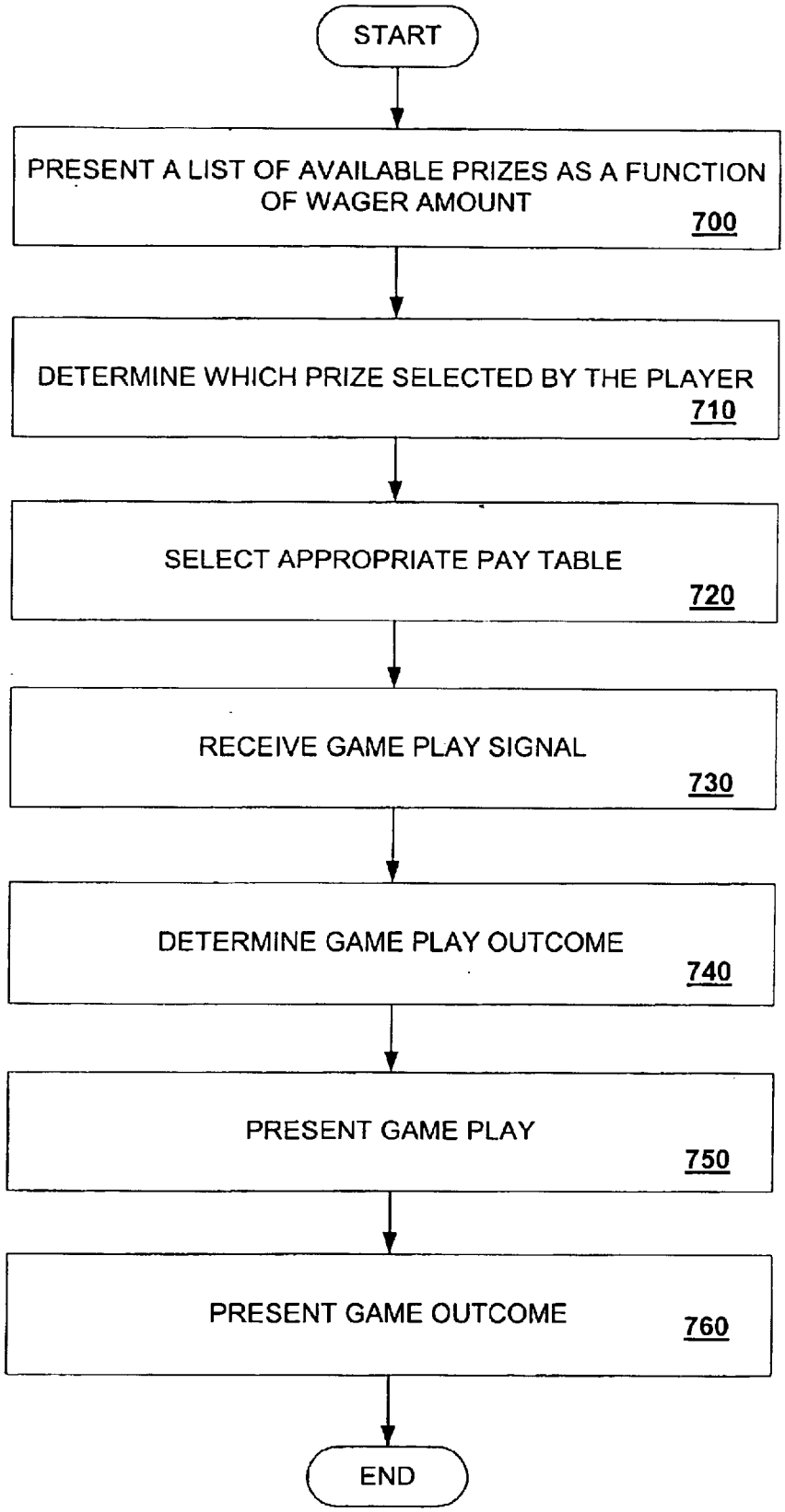
FIG. 7 is a flow chart depicting a name your prize, prize selection methodology on a gaming machine.

FIG. 7 is a flow chart depicting the name your prize, prize selection methodology on a gaming machine. In step 700, a list of available prizes on the gaming machine is presented. The list of prizes may be in a graphical or textual format and organized in some display format as described in reference to FIGS. 2 and 3. The prizes available for selection may be optionally a function of the amount of money wagered by the player. In step 710, after a player has selected a prize using an input method of some type, the gaming machine determines which prize was selected by the player. The prize selected by the player might be displayed on a display screen or a display mechanism of some type visible to the player. The player might select a prize using a touch screen, key pad, input buttons or some other input method to select a prize. The odds of winning a particular prize may be related to some feature of the prize. For example, the odds of winning a prize may decrease as the value of the prize increases. Thus, after the prize selected by the player is determined, the gaming machine selects a pay-table containing the appropriate odds of winning the selected prize in step 720.

In step 730, a game is initiated when the gaming machine receives a game play signal. The game play signal might be initiated on the gaming machine when a player pulls a lever or presses a button on the gaming machine. Usually using a random number generator, the gaming machine determines the outcome of the game in step 740 from the pay table selected in step 720. In step 750, game play is presented. For example, for a slot machine, game play consists of the mechanical slot reels or graphical slot reels on a video display screen rotating. The gaming machine may generate sounds, flashing lights or other effects discernible to the player while the slot reels are rotating. In step 760, the outcome of the game is presented. For example, for a slot game, the game outcome presented is usually each of the displayed slot reels stopping in a particular position. The slot game outcome is represented by the symbols displayed on each slot reel when the reels have stopped. After completing the game, a player might save prize information selected on the gaming machine to a portable storage device including a magnetic card, a smart card or a paper print-out. The prize information on the portable storage device might be used when a player wished to play for a similar prize on another gaming machine or the on the same gaming machine at a later time.

Although the foregoing invention has been described in some detail for purposes of clarity of understanding, it will be apparent that certain changes and modifications may be practiced within the scope of the appended claims. For instance, while the gaming machines of this invention have been depicted as having gaming devices physically attached to a main gaming machine cabinet, the use of gaming devices in accordance with this invention is not so limited. For example, the display screen features which may be provided on a top box may be included in a stand alone cabinet proximate to, but not unconnected to, the main gaming machine chassis.

What is claimed is:

1. A gaming machine comprising:

a master gaming controller designed or configured to control a game of chance played on the gaming machine wherein the gaming machine is operable for each a played game of chance to:

1) receive a selection of a non-cash prize from a game player from a list of prizes prior to determining the outcome of the played game of chance wherein the non-cash prize corresponds to an award for at least one outcome for the played game of chance and the non-cash prize is only awarded after the outcome of the played game of chance is determined and wherein the gaming machine is operable to award the selected non-cash prize as a result of only the game of chance to be played following the prize selection, independent of any previous games of chance played on the gaming machine and to only provide prize redemption of non-cash prizes that are awarded in this manner;

2) determine the outcome for the played game of chance wherein odds for all possible outcomes of the played game of chance are generated prior to the selection of the non-cash prize;

3) display the outcome for the played game of chance and 4) indicate an award of the non-cash prize when the determined outcome for the played game of chance is the same as the at least one outcome for the played game of chance corresponding to the non-cash prize;

a memory for storing the list of prizes; and a prize display mechanism for displaying the list of prizes stored in the memory; and a prize selection mechanism for allowing the game player to select the non-cash prize wherein the list of prizes includes cash prizes and two or more non-cash prizes.

2. The gaming machine of claim 1, wherein the non-cash prizes are selected from the group consisting of merchandise, vacations, airline miles, ad shopping sprees.

3. The gaming machine of claim 1, wherein the prize selection mechanism allows the user to select one or more specific to a wager amount of the game of chance played on the gaming machine.

4. The gaming machine of claim 1, wherein the gaming machine is a mechanical slot machine, a video slot a machine, a keno game, a lottery game, or a video poker game.

5. The gaming machine of claim 1, wherein a probability of the outcome of the game of chance played on the gaming machine is specific to a value of the selected prize.

6. The gaming machine of claim 1, wherein the prize selection mechanism is a key pad a button panel, a video touch screen, a mouse, a touch pad, a joystick, a microphone or a magnetic card.

7. The gaming machine of claim 1, wherein the prize display mechanism is a printed sign a video display screen, a bonus wheel, a video touch screen, an LCD (Liquid Crystal Display), a back-lit glass panel ar a prize.

8. The gaming machine of claim 1, wherein the memory is an EEPROM (Electronically Erasable Programmable-Read only Memory), a CD-ROM (Compact Disc-Read Only memory), DVD (Digital Versatile Disc), a non-volatile memory, or a magnetic storage device.

9. The gaming machine of claim 1, wherein the gaming machine provides a display format for the one or more prizes displayed on the display mechanism.

10. The gaming machine of claim 9, wherein the display format is graphical or textual.

11. The gaming machine of claim 9, wherein the display format indicates a feature of the prize.

12. The gaming machine of claim 11, wherein the prize feature is a prize value.

13. The gaming machine of claim 11 wherein the prize feature is a prize theme.

14. A prize distribution network comprising:

(a) a prize server comprising;

an interface for providing prize information to one or more gaming machines wherein at least one of the gaming machines is external to the prize server; and a memory storing the prize information as groups of prizes for separate display one or more gaming machines; and (b) a plurality of gaming machines each machine comprising;

a memory storing a list of prizes; and a prize display mechanism displaying the prizes; and a prize selection mechanism for selecting one or more for one or more outcomes of a game of chance played on the gaming machine wherein the prizes include cash es and non-cash prizes and wherein at least one gaming machine of the plurality of gaming machines is operable for each played game of chance on the at lest one gaming machine to: 1) receive a selection of a non-cash prize from a game player from a list of prizes prior to determining the outcome of the played game of chance wherein the non-cash prize corresponds to an award for at least one outcome for the played game of chance and wherein the non-cash prize is only awarded after the outcome of the played game of chance is determined and wherein the gaming machine is operable to award the selected non-cash prize as a result of only the game of chance to be played following the prize selection and independent of any previous games of chance played on the gaming machine and only provide prize redemption of non-cash prizes that are awarded in this manner, 2) determine the outcome for the played game of chance wherein odd for all possible outcomes of the played game of chance are generated prior to the selection of the non-cash prize: 3) display the outcome for the played game of chance and 4) indicate an award of the non-cash prize when the determined outcome for the played game of chance is the same as the at least one outcome for the played game of chance corresponding to the non-cash prize.

15. The prize distribution network of claim 14 wherein the game of chance is selected from the group consisting of a slot game, keno game a lottery game or a poker game.

16. The prize distribution network of claim 14 wherein the non-cash prizes are selected from the group consisting of merchandise, vacations, airline miles, and shopping sprees.

17. The prize distribution network of claim 14, wherein the prize server is a one of the plurality of gaming machines.

18. The prize distribution network of claim 14, wherein the prize server is configured to receive prize fulfillment information used to redeem prizes won by players playing the gaming machines.

19. The prize distribution network of claim 14, further comprising:

a prize fulfillment center that is used to acquire and deliver prizes.

20. In a gaming machine having a prize selection mechanism, a prize display mechanism for displaying a list of prizes, a method of selecting a prize specific to an outcome of a game of chance played on a gaming machine, the method comprising;

displaying multiple prizes available for selection on the prize display mechanism wherein the prizes include cash prizes and two or more non-cash prizes;

receiving an input signal from the prize selection mechanism for selecting a non-cash prize from the list of prizes prior to determining the outcome of the game of chance said input signal corresponding to a game players selection of the selected prize wherein the selected prize corresponds to an award for one of the outcomes of the game of chance and wherein the prize is only awarded after the outcome of the played gone of chance is determined wherein the gaming machine is operable to award the selected non-cash prize as a result of only the game of chance to be played following the prize selection, independent of any previous games of chance played on the gaming machine and only to provide prize redemption of non-cash prizes that are awarded in this manner;

receiving a wager for the game of chance;

determining the outcome for the game of chance wherein odds for all possible outcomes of the played game of chance are generated prior the selection of the prize;

presenting the outcome for the game of chance; and indicating an award of the selected prize when the determined outcome for the game of chance is the same as the one the outcomes of the game of chance corresponding to the prize selection.

21. The method of claim 20, wherein the non-cash prizes are selected from the group consisting of merchandise, vacations, airline miles, and shopping sprees.

22. The method of claim 20, further comprising determining a pay table to be used in determining the outcome for the game of chance, wherein the pay table is chosen according to the value of the selected prize.

23. The method of claim 20, further comprising outputting the selected prizes to a portable memory device.

24. The method of claim 23, wherein the portable memory device is a magnetic card, a personal digital assistant or a smart card.

25. The method of claim 20, wherein the prize selection mechanism is a key pad, a button panel, a touch screen, a mouse, touch pad, joystick a microphone, a smart card or a magnetic card.

26. The method of claim 20, further comprising receiving a signal for initiating the game of chance.

27. The method of claim 20, further comprising displaying a group of prizes available for selection in the prize display mechanism specific to a wager amount.

28. The method of claim 20, wherein the game of chance is a slot game, a keno game, a lottery game, or a poker game.

29. The method of claim 20, further comprising displaying the selected prize on the prize display mechanism.

30. The method of claim 20, wherein the prize display mechanism is a printed sign, a video display screen, a bonus wheel a video touch screen, back-lit glass panel or an LCD (Liquid Crystal Display).

31. The method of claim 20 further comprising:

printing a record of the selected prizes.

32. In a prize distribution network comprising a plurality of gaming machines connected to a prize server, a method for distributing information about prizes available on specific gaming machines, the method comprising, establishing communication with each gaming machine connected to the prize server; and sending prize information from a memory on the prize server to a memory on each gaming machine; said prize information specific to prizes which are available for selection by game players as game awards on games played on the gaming machines wherein the prizes include cash prizes and non-cash prizes and wherein at least one gaming machine is operable for each played game of chance on the least one gaming machine to; 1) receive a selection of a non-cash prize from a game player from a list of prizes prior to determining the outcome of the played game of chance wherein the non-cash prize corresponds to an award for at least one outcome for the played game of chance and wherein the non-cash prize is only awarded after the outcome of the played game of chance is determined and wherein the gaming machine is operable to award the selected non-cash prize as a result of only the game of chance to be played following the prize selection and independent of any previous games of chance played on the gaming machine and to only provide prize redemption non-cash prizes that are awarded in this manner, 2) determine the outcome for the played game of chance wherein odds for all possible outcomes of the played game of chance are generated prior to the selection of the non-cash prize; 3) display the outcome for the played game of chance and 4) indicate an award of the non-cash prize when the determined outcome for the played game of chance is the same as the at least one outcome for the played game of chance corresponding to the non-cash prize.

33. The method of claim 32, wherein the game of chance is a slot game, a keno game, a lottery game, or a poker game.

34. The method of claim 32, wherein the prizes are selected from the group consisting of merchandise, vacations, airline miles and shopping sprees.

35. The method of claim 32 further comprising displaying the prize information to a video display screen associated with one or more of the gaming machines.

36. The method of claim 35, further comprising identifying one or more prizes selected by a user.

37. The method of claim 36, further comprising outputting the selected prize information to a portable storage device which can be read by one or more of the gaming machines.

* * * * *

UNITED STATES PATENT AND TRADEMARK OFFICE

CERTIFICATE OF CORRECTION

PATENT NO. : 6,857,959 B1
APPLICATION NO. : 09/515717
DATED : February 22, 2005
INVENTOR(S) : Binh T. Nguyen It is certified that error appears in the above-identified patent and that said Letters Patent is hereby corrected as shown below:

Column 5, line 15, change “gaming a machines” to --gaming machines--.

Column 6, line 57, change “tabular formal” to --tabular format--.

Column 13, line 30, change “gaining machine” to --gaming machine--.

Column 15, line 59, delete “not” after “but”.

In line 5 of claim 1 (column 15, line 67) delete “a” after “each”.

In line 10 of claim 1 (column 16, line 5) change “and the” to --and wherein the--.

In line 3 of claim 2 (column 16, line 32) change “ad” to --and--.

In line 3 of claim 3 (column 16, line 35) change “or more” to --or more prizes--.

In line 2 of claim 4 (column 16, line 38) delete “a” after “slot”.

In line 4 of claim 7(column 16, line 51) change “panel ar” to --panel or--.

In line 7 of claim 14 (column 17, line 7) add --on the-- after “display”.

In line 9 of claim 14 (column 17, line 9) add --gaming-- after “each”.

In line 13 of claim 14 (column 17, line 13) add --prizes-- after “more”.

In line 15 of claim 14 (column 17, line 15) change “cash es” to --cash prizes--.

In line 18 of claim 14 (column 17, line 18) change “at lest” to --at least--.

In line 30 of claim 14 (column 17, line 30) change “and only” to --and to only--.

In line 3 of claim 15 (column 17,line 44) change “keno game” to --a keno game--.

In line 2 of claim 17 (column 17, line 48) change “is a one” to --is one--.

In line 16 of claim 20 (column 18, line 6) change “played gone” to --played game--.

In line 22 of claim 20 (column 18, line 13) change “only to” to --to only--.

In line 27 of claim 20 (column 18, line 18) change “prior the” to --prior to the--.

UNITED STATES PATENT AND TRADEMARK OFFICE

CERTIFICATE OF CORRECTION

PATENT NO. : 6,857,959 B1
APPLICATION NO. : 09/515717
DATED : February 22, 2005
INVENTOR(S) : Binh T. Nguyen It is certified that error appears in the above-identified patent and that said Letters Patent is hereby corrected as shown below:

In line 3 of claim 30 (column 18, line 51)) change “wheel a video” to --wheel, a video --.

Signed and Sealed this

Fifteenth Day of August, 2006

JON W. DUDAS
*Director of the United States Patent and Trademark Office*